US005765685A

United States Patent [19]

Roosa

[11] Patent Number: 5,765,685

[45] Date of Patent: Jun. 16, 1998

[54] CARRIER WITH ARTICLE RETAINING MEANS

[75] Inventor: Paul Roosa, West Hurley, N.Y.

[73] Assignee: Riverwood International Corporation, Atlanta, Ga.

[21] Appl. No.: 872,314

[22] Filed: Jun. 10, 1997

[51] Int. Cl.[6] ..... B65D 71/18

[52] U.S. Cl. ..... 206/434; 206/140

[58] Field of Search ..... 206/140, 141, 206/147, 151–153, 427, 429, 430, 434

[56] References Cited

U.S. PATENT DOCUMENTS

| | | | |
|---|---|---|---|
| 5,439,112 | 8/1995 | De Guglielmo et al. | 207/147 |
| 5,484,059 | 1/1996 | Sutherland | 206/140 |
| 5,620,094 | 4/1997 | Naumann | 206/434 |
| 5,671,845 | 9/1997 | Harris | 206/140 |

*Primary Examiner*—Jimmy G. Foster

[57] ABSTRACT

A wrap-around carrier suitable for packaging tub-shaped articles which have recessed bottom portions. The bottom panel is formed from an inner flap to which article retainer flaps are hinged and an outer flap to which secondary locking tabs are hinged. The retainer flaps are pivoted into the interior of the carrier by the locking tabs and include edges which contact the bottom portions of adjacent articles and also foldable retainer tabs which also contact the bottom portions. A projection on the locking tabs extends through an opening in the retainer flap and the end edge of the locking tab supports the retainer flap. A further opening in the retainer flap receives a locking tab shoulder to prevent withdrawal of the locking tab. A slit in the inner bottom panel flap allows passage of another locking tab shoulder which engages the inner bottom panel flap to further prevent withdrawal. In addition, stepped dividers extend inwardly on opposite sides of the articles to prevent movement of the articles during formation of the carrier.

20 Claims, 3 Drawing Sheets

CARRIER WITH ARTICLE RETAINING MEANS

FIELD OF THE INVENTION

This invention relates to wrap-around article carriers, and more particularly to article carriers designed to package containers having stepped sides.

BACKGROUND OF THE INVENTION

Wrap-around carriers are employed to package a variety of different types of articles, one of which is a tapered food containing tub. Typically, the tubs are packaged in two adjacent rows. Since the tubs are inwardly tapered toward the bottom, the bottom portions of the tubs in adjacent rows are spaced apart. This makes it especially difficult to wrap them tightly enough to prevent movement of the tubs when the package is lifted and carried. Movement of the containers is a problem even when the carrier includes side slots through which flanges on the tops of the tubs protrude, since such an arrangement does not hold the bottom portions of the tubs tightly in place.

To overcome these problems it has been suggested to provide retaining flaps which are wedged between the bottom portions of adjacent tubs to hold them in place. Although this prevents the spaced bottom portions of articles from moving with respect to each other and toward the open end of the carrier, it requires additional operating steps to activate the flaps. Also, the space taken up by the retaining flaps limits the design of the mechanical locking means employed to secure the bottom panel flaps of the carrier. An improved arrangement which overcomes these objections is disclosed in U.S. Pat. No. 5,484,059. In that design retaining flaps extending up from one of the bottom panel flaps are activated by the insertion of male secondary locking tabs attached to the other bottom panel flap. The retaining flaps lie between the bottoms of adjacent rows of tapered tubs.

That solution is not designed, however, to retain tubs which are only partially tapered, having a substantially vertical base extending from the bottom of the tub to the lower end of the tapered wall. Further, the patented design shows the use of only one primary male tab in a carrier used to package two rows of tubs, where each row contains two tubs. It is preferred to employ a design which makes use of a male primary locking tab for each tub in a row.

One approach to stabilizing partially tapered tubs has been to provide the carrier with a center keel, either triangular or square in cross section. The bottom portions of the tubs contact both the side panels of the carrier and the keel, holding the tubs in place. While this arrangement prevents the tubs from moving within the carrier, the design is relatively expensive due to the amount of paperboard required to form the keel. The formation of the keel also decreases the forming speed of packaging machines used to package the product.

It would be highly desirable to provide a wrap-around carrier capable of packaging stepped partially tapered articles without making use of the usual type of center divider keel and without compromising the bottom panel locking means. It would also be desirable for such a carrier to be relatively inexpensive to form.

BRIEF SUMMARY OF THE INVENTION

The invention is incorporated in a wrap-around article carrier containing a plurality of adjacent rows of articles the bottom portions of which are spaced apart. Opposite side panels are connected to a top panel and to bottom panel flaps which form the bottom panel. One of the bottom panel flaps is an inner bottom panel flap connected to one of the side panels and an overlapping outer bottom panel flap connected to the opposite side panel. The inner bottom panel flap includes an integral article retainer flap adjacent each end edge flap, each article retainer flap being comprised of an upwardly extending leg connected to an inwardly extending arm, the leg of each retainer flap being hinged to the inner bottom panel flap and the arm of each retainer flap including an opening therein. The outer bottom panel flap includes a locking tab associated with each retainer flap, each locking tab extending through an opening in the inner bottom panel into the interior of the carrier, and each locking tab having a projection extending upwardly from an end edge.

The projection of each locking tab extends through the opening in the arm of an associated retainer flap and the end edge of each locking tab contacts the arm of an associated retainer flap. The retainer flaps are located between, and engage, the spaced bottom portions of articles in the adjacent rows. In addition, means are provided for preventing withdrawal of the locking tabs from engagement with the retainer flaps. Preferably, the means for preventing withdrawal of the locking tabs comprises a shoulder on each tab engaging an edge of an opening in the leg of an associated retainer flap. It may also comprise a second shoulder on each tab engaging the interior face of the inner bottom panel flap.

By this arrangement the locking tabs are securely held in place to assist in holding the bottom panel flaps in their overlapping relationship. They also act to activate the retainer flaps and to maintain them in activated position, thereby preventing the packaged articles from moving. The retainer flaps may further include hinged retainer tabs which contact the bottom portions of adjacent spaced articles.

While the invention functions to hold the articles in place in the completed carrier, it may be desirable to provide positive means for preventing movement during the packaging process. In this connection, the invention also provides for the use of spaced dividers which function both during and after packaging to maintain the articles in place.

The above and other aspects of the invention, as well as other benefits, will readily be apparent from the more detailed description of the preferred embodiment which follows.

DETAILED DESCRIPTION OF THE PREFERRED EMBODIMENT

Figure 1:
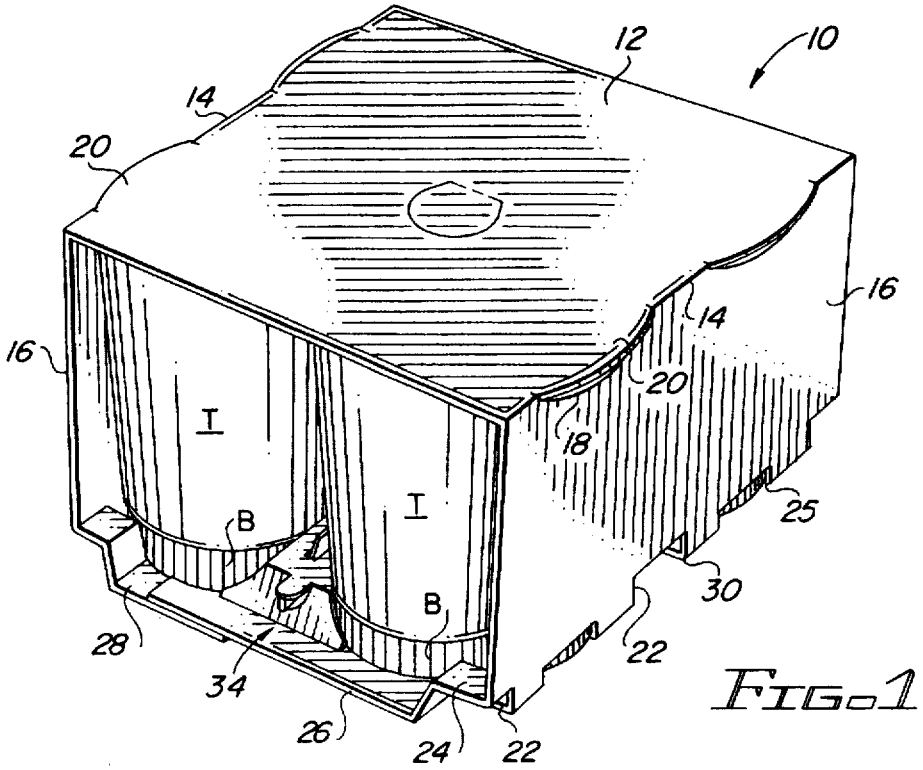
FIG. 1 is a pictorial view of a wrap-around carrier incorporating article retaining means of the invention.
Figure 2:
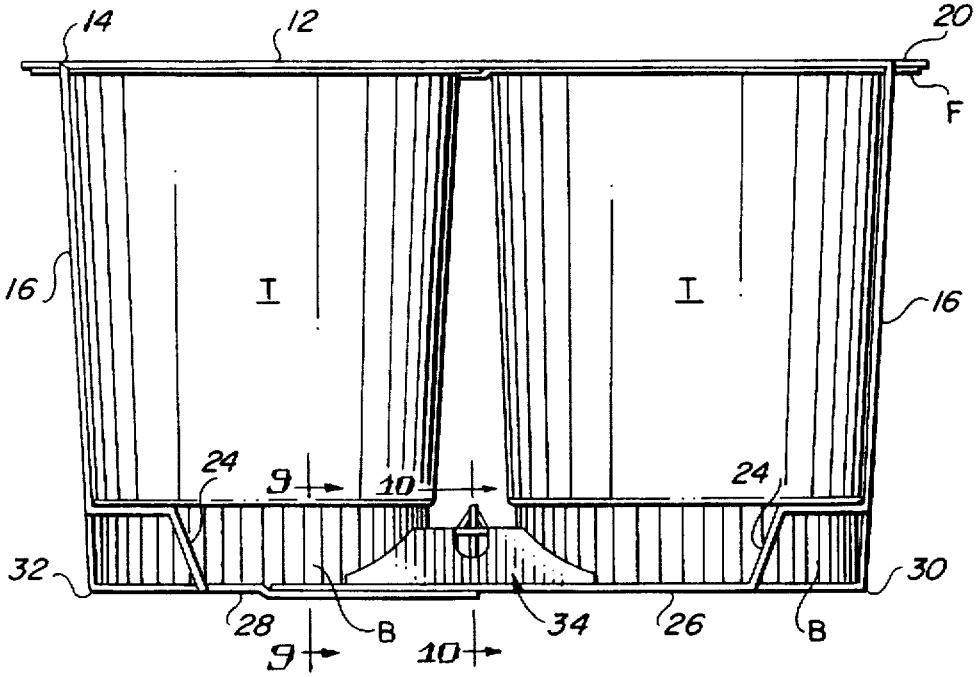
FIG. 2 is an end view of the carrier of FIG. 1.
Figure 3:
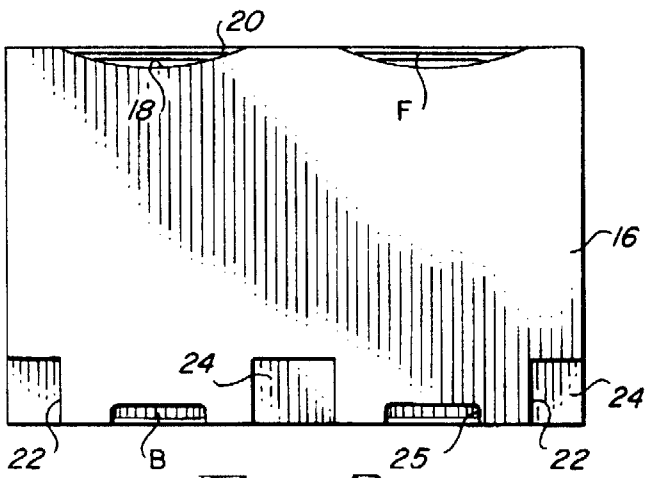
FIG. 3 is a side view of the carrier of FIG. 1.

Referring to FIGS. 1, 2 and 3, a wrap-around carrier 10 comprises a top panel 12 connected along fold lines 14 to side panels 16. For the purpose of illustrating the invention, the articles T contained in the carrier are shown as comprising two parallel rows of tubs of the type used to contain soft food, such as yogurt or pudding or the like, each row being comprised of two tubs. The sides of each tub are slightly tapered down to a point representing the actual bottom of the container, and a vertical base portion B joins the bottom of the tub at a point recessed from the tub sides. Cutouts 18 are provided in the side panels adjacent the top panel 12 through which top flanges F of the tubs T extend, and tabs 20 extend out from the top panel to cover the tub flanges. The flanges F are quite thin, enabling the flanges of adjacent tubs to overlap. The side and bottom panels of the carrier include coextensive cutouts 22 which allow the formation of stepped tabs 24, the function of which is explained below. In addition, coextensive cutouts 25 in the side and bottom panels are provided at each tub location for a purpose explained below.

The bottom panel is formed by overlapped inner and outer bottom panel flaps 26 and 28. The inner bottom panel flap 26 is connected to one of the side panels 16 along fold line 30 while the outer bottom panel flap 28 is connected to the other side panel 16 along fold line 32. Extending up from the bottom panel between the end articles T of the adjacent rows of articles is a retainer flap or divider keel 34. The retainer keel is contoured, as described more fully below, and fits snugly between the vertical base portions B of adjacent end tubs, preventing the tubs from moving either toward the open end of the carrier or in a transverse direction away from the side panels 16.

Figure 4:
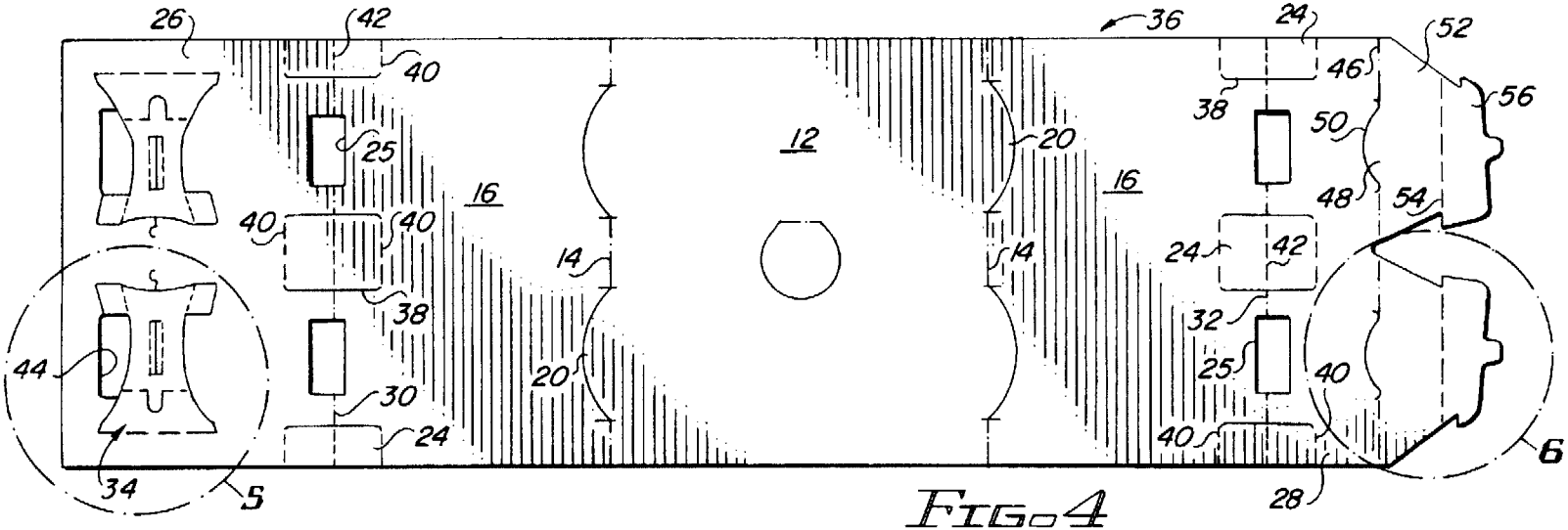
FIG. 4 is a plan view of a blank for forming the carrier of FIG. 1.

As shown in FIG. 4, wherein like reference numerals to those used in FIGS. 1, 2 and 3 denote like elements, a blank for forming the carrier 10 comprises a substantially rectangular sheet 36 of paperboard or other suitable material having adequate flexibility and strength, with the top panel section 12 being centrally located and the other panel sections described above being successively connected along the fold lines referred to above. Slits 38, which cross the fold lines 30 and 32, are connected by fold lines 40 to form the cutouts 22 and the stepped divider tabs 24 shown in FIGS. 1, 2 and 3. Fold lines 42, within the stepped tab portions, are continuations of the fold lines 30 and 32, while the cutouts 25 interrupt the fold lines 30 and 32. The inner bottom panel flap 26 incorporates the keel or retainer flaps 34 at opposite ends of the flap 26, as well as primary female locking openings 44 adjacent the retainer flaps 34. The outer bottom panel flap 28 includes a fold line 46 spaced from and parallel to the fold line 32. Primary locking tabs 48 are formed by slits 50 which interrupt the fold line 46. Connected to the flap 28 along the fold lines 46 are two spaced secondary locking tabs 52, each including a transverse fold line 54 which creates an outer secondary locking tab portion 56.

Figure 5:
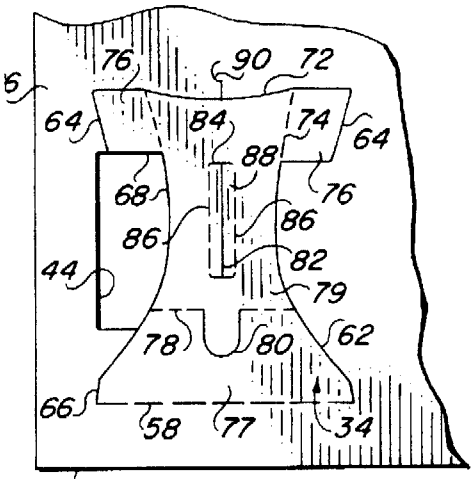
FIG. 5 is an enlarged plan view of the portion of FIG. 4 enclosed within the rectangle 5.

Referring back to the opposite end of the blank 36 and to FIG. 5, each retainer flap 34 is connected to the inner bottom panel flap 26 by a fold line 58 which is spaced from and is substantially parallel to the adjacent edge 60 of the flap 26. The side edge of the retainer flap farthest from the near end of the blank is defined by slit 62 extending from the inner end of the fold line 58, and slit 64. The opposite side edge of the retainer flap is defined by slit 66, extending from the other end of the fold line 58, slit 64 and edges 68 of the primary female locking opening 44. Slit 72, which extends in the same general direction as the fold line 58, connects the slits 64. In addition, fold lines 74, extending from the slit 62 and the cutout 44 to the slit 72, form retainer tabs 76. A further fold line 78, spaced from and substantially parallel to the fold line 58, extends across the flap 34 and is interrupted by U-shaped slit 80. The fold line 78 divides the retainer flap into a leg portion 77 and an arm portion 79.

Spaced between the slit 62 and the cutout 44 is slit 82, which with transverse slits 84 and fold lines 86 forms narrow flaps 88. In addition, the bottom panel flap 26 includes a slit 90, consisting of a straight portion and a curved portion, extending from the slit 72. The slit 82, the straight portion of slit 90 and the centerline of U-shaped slit 80 lie substantially in the same plane. Note that substantial portions of the slit 62 and the connected fold line 74 comprise a generally arcuate arrangement, and that the same is true of portions of the inner edge 68 of cutout 70, a portion of the slit 66 and the associated fold line 74. These elements ultimately form generally arcuate edges of the activated retainer flaps for engagement with the curved surface of an adjacent article base.

Figure 6:
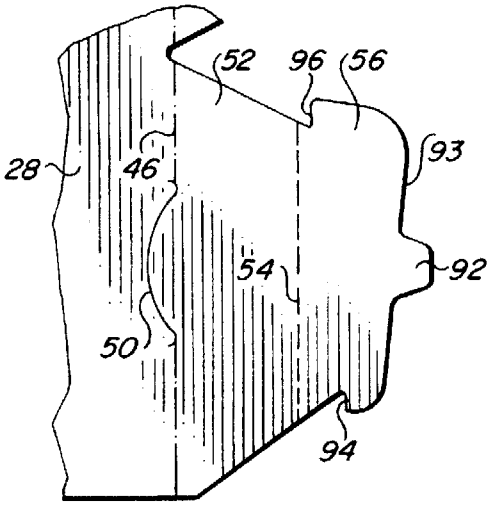
FIG. 6 is an enlarged plan view of the portion of FIG. 4 enclosed within the rectangle 6.

Still referring to FIG. 4, and also to FIG. 6, the outer portion 56 of each secondary locking tab 52 includes an outwardly extending tab or projection 92 extending from the and edge 93 of the locking tab and shoulders 94 and 96 at opposite ends of the tab. The projections 92 are aligned with the slits 82 of the retainer flaps, while the shoulders 94 and 96 are aligned with the retainer flap slits 80 and 90, respectively. Note that the shoulder 96 is quite close to the fold line 54, while the shoulder 94 is spaced a greater distance from the fold line 54.

Figure 7:
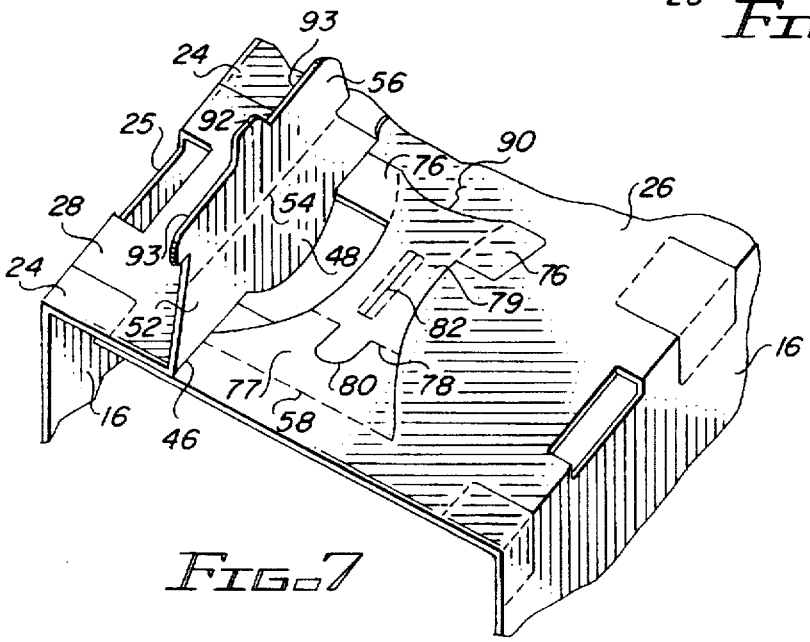
FIG. 7 is a pictorial view of the carrier showing the bottom panel flaps at an initial stage of assembly, with the articles to be packaged omitted for purpose of clarity.

To form a carrier the blank 36 is wrapped around the tubs or other similarly shaped articles with the inner bottom panel flap 26 being folded about fold line 30 against the bases of the tubs and the outer bottom panel flap 28 being folded about fold line 32, as illustrated in FIG. 7. Although the carrier wrapper is inverted in this view, it will be understood that the carrier could be formed while in normal upright condition as well. When the bottom panel flaps are pulled to their final location shown, the secondary locking tabs 52 are folded about fold lines 46 to a substantially upright position. This moves the primary locking tabs 48 out of the plane of the outer bottom panel flap 28. The primary locking tab illustrated is shown as being aligned with the straight locking edge of the cutout 44, so that when the associated secondary locking tab is later folded back to its original planar relationship with the outer bottom panel flap 28, the primary locking tabs 48 will be locked in position on the interior side of the inner bottom panel flap 26, lying substantially parallel to the bottom panel flaps.

Figure 8:
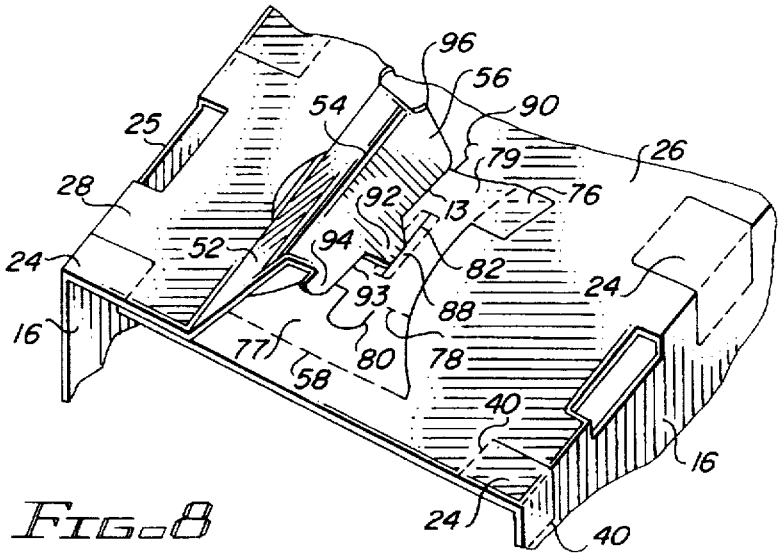
FIG. 8 is a pictorial view of the carrier similar to that of FIG. 7, but showing the bottom panel flaps at the next stage of assembly.

The secondary locking tabs 52 are then folded about the fold lines 54, causing the tab projection 92 to be aligned with the slit 82 of the retainer flaps 34, as illustrated in FIG. 8. As the secondary locking tabs are pushed into place the tabs 24 are separately activated by pushing them in toward the interior of the carrier. This action causes the tabs 24 to swing inwardly about the fold lines 40, folding about central fold lines 42 to form the stepped configuration shown in FIGS. 1–3. The formed stepped tabs 24 engage opposite sides of the base portion of each tub to prevent the tubs from moving within the partially formed carrier while the retainer flaps are being formed. The cutouts 25 permit access of packaging machine elements, which are not shown but are well known in the art, used to draw the bottom panel flaps together to produce a tightly wrapped carrier.

The final step in carrier formation is to push the outer portions 56 of the secondary locking tabs 52 into the interior of the carrier. As the tab projections 92 enter the slits 82, the edge 93 of each outer tab portion 56 adjacent the tab 92 engages the arm 79 of the associated retainer flap 34 and pushes the retainer flap out from the bottom panel flap 26, causing the leg 77 of the retainer flap to pivot about its fold line 58 into the interior of the carrier. Because the retainer flaps are located between the bottoms of the two rows of tubs, the retainer flaps are able to freely move in this manner in the space between the rows of tubs. As the retainer flap legs pivot into the interior of the carrier the opposite edges of the legs and the opposite edges of the retainer flap arms contact the adjacent tubs. This movement also brings the retainer tabs 76 into contact with adjacent tubs, causing the retainer tabs to be folded down about the fold lines 74 until they lie flat and somewhat vertical against the base portions of adjacent tubs.

Figure 9:
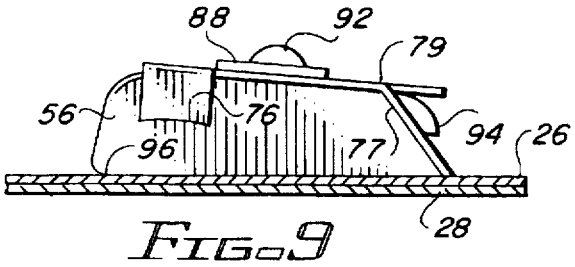
FIG. 9 is an enlarged partial sectional view, omitting the packaged articles, taken on the line 9—9 of FIG. 2.

At this point the shoulder 94 of the secondary locking tabs engages the flap formed by the U-shaped slit 80 of the retainer flaps and pushes it away from the retainer flap leg 77 to form an opening in its place. Movement of the outer portion of the secondary locking tabs continues until the edge 94 snaps into contact with the edge of the opening in the retainer flap leg formed by the slit 80. At this point the shoulder 96 will have passed through the straight portion of the slit 90, flexing back the portion of the bottom panel flap 26 adjacent the curved section of the slit 90. The shoulder 96 will then be in contact with that portion of the bottom panel flap. The engagement of the shoulders 94 and 96 with the structure just noted completes the formation of the retainer flaps and prevents withdrawal of the secondary locking tabs 52 from their locked positions. The retainer flaps or keels are thus locked in place, preventing movement of the tubs. This arrangement is more clearly illustrated in FIGS. 9 and 10, which show two views of a fully inserted secondary locking tab. In FIG. 9 the downwardly folded retainer tab 76 is visible, and in FIG. 10 the relationship of the shoulders 94 and 96 with their associated locking structure is can be seen.

Figure 10:
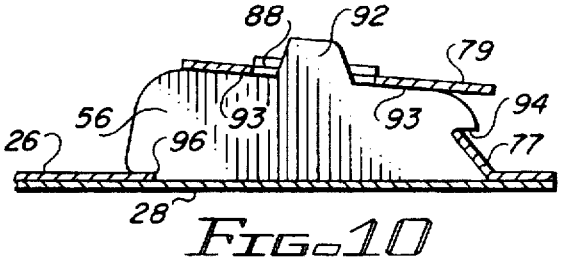
FIG. 10 is an enlarged partial sectional view, omitting the packaged articles, taken on line 10—10 of FIG. 2.

As best seen in FIGS. 9 and 10, the arm portion 79 of the retainer flap forms a slight angle with the bottom panel of the carrier. This is because the arm portion 79 is in contact with the end edge 93 of the secondary locking tabs which, as shown in FIG. 10, is slightly sloped with respect to the bottom panel flap 28. It can be seen in FIG. 6 that this arrangement is the result of the end edge 93 being slightly angled with respect to the fold lines 46 and 54. Although not essential to the activation or functioning of the retainer flaps, this relationship is preferred since it allows for slight dimensional variations while providing for at least a portion of the retainer flap arm to abut adjacent articles at the shoulder formed by the recessed base portion B of the article tubs.

It will be understood that the dimensions and shape of the retaining flaps and the location of the retainer tabs 76 are selected to cause the edges of the retainer flaps to engage the curved base portions of the packaged tubs and the retainer flaps to also engage the base portions. Although the invention has been illustrated by a carrier designed to hold only two articles in each row, those skilled in the art will readily be able to increase the length of the carrier and the number of retainer flaps to accommodate more than two articles in each row. Those skilled in the art will also understand that the small flaps 88 in the arm of the retainer flaps need not be present for the retainer flaps and locking mechanisms to properly function, although they are preferred in order to provide a tight fit between the locking tab projections 92 and the retainer flap slits 82 while allowing for slight variations in alignment of the projection and slit.

It can now be appreciated that the article retaining means of the invention provides an effective retainer which engages substantial portions of the end tubs or other articles in a carrier which have spaced bottom portions, and does so without adding to the material cost of the carrier blank. In addition, the retaining means provides an additional mechanical lock between the flaps forming the bottom panel, thus further ensuring against the accidental escape of articles from the carrier through failure of the bottom panel. As previously noted, the stepped divider tabs provide still further protection against article movement, both during the packaging process and in the formed package.

It should be apparent that the invention need not be limited to all the specific details described in connection with the preferred embodiment, but that changes to certain features of the preferred embodiment which do not alter the overall basic function and concept of the invention may be made without departing from the spirit and scope of the invention, as defined in the claims.

What is claimed is:

1. A wrap-around article carrier containing a plurality of adjacent rows of articles the bottom portions of which are spaced apart, comprising:

a top panel;

opposite side panels connected to the top panel;

a bottom panel comprised of an inner bottom panel flap connected at a side edge thereof to one of the side panels and an outer bottom panel flap connected at a side edge thereof to the opposite side panel, each bottom panel flap having opposite end edges;

the inner bottom panel flap including an integral article retainer flap adjacent each end edge of the inner bottom panel flap, each article retainer flap being comprised of an upwardly extending leg connected to an inwardly extending arm, the leg of each retainer flap being hinged to the inner bottom panel flap and the arm of each retainer flap including an opening therein;

the outer bottom panel flap including a locking tab associated with each retainer flap, each locking tab extending through an opening in the inner bottom panel into the interior of the carrier, each locking tab having a projection extending upwardly from an end edge;

the projection of each locking tab extending through the opening in the arm of an associated retainer flap and the end edge of each locking tab contacting the arm of the associated retainer flap;

the retainer flaps being located between, and engaging, the spaced bottom portions of articles in the adjacent rows; and means for preventing withdrawal of the locking tabs from engagement with the retainer flaps.

2. A wrap-around article carrier as defined in claim 1, wherein the opening in the arm of each retainer flap is a slit.

3. A wrap-around article carrier as defined in claim 1, wherein the means for preventing withdrawal of the locking tabs comprises a shoulder on each tab extending through an opening in the leg of an associated retainer flap and engaging an edge of said opening.

4. A wrap-around article carrier as defined in claim 3, wherein the means for preventing withdrawal of the locking tabs further comprises a second shoulder on each tab engaging the interior face of the inner bottom panel flap.

5. A wrap-around article carrier as defined in claim 1, wherein the arm of each retainer flap is connected to the leg of the retainer flap by a fold line.

6. A wrap-around article carrier as defined in claim 1, wherein each retainer flap includes retainer tabs connected on opposite sides thereof along fold lines, the retainer tabs contacting the bottom portions of adjacent spaced articles.

7. A wrap-around article carrier as defined in claim 1, wherein the bottom portions of the articles extend substantially vertically.

8. A wrap-around article carrier as defined in claim 7, wherein the bottom portions of the articles are inwardly recessed from the sides of the articles, the sides of the articles being tapered in a downward direction.

9. A wrap-around article carrier as defined in claim 1, wherein the locking tabs are secondary locking tabs, the outer bottom panel flap containing at least one primary locking tab engaging a primary locking opening in the inner bottom panel flap.

10. A wrap-around article carrier as defined in claim 1, including coextensive openings in the bottom panel and each side panel at opposite ends of the carrier and between adjacent articles in each row, and an inwardly extending stepped divider hingedly connected to opposite edges of each coextensive opening.

11. A wrap-around article carrier as defined in claim 1, wherein the leg of each article retainer flap is hinged to the inner bottom panel flap along a fold line which is substantially parallel to the adjacent end edge of the inner bottom panel flap.

12. A blank for forming a wrap-around carrier for packaging a plurality of adjacent rows of articles the bottom portions of which are spaced apart, comprising:

a generally rectangular sheet having a central top panel section;

side panel sections connected to opposite sides of the top panel section by fold lines;

a first bottom panel flap connected to one of the side panel sections along a first fold line and a second bottom panel flap connected to the other side panel section along a second fold line, each bottom panel flap having opposite end edges;

the first bottom panel flap including an article retainer flap adjacent each end edge of the first bottom panel flap, each article retainer flap being comprised of a leg hinged to the inner bottom panel flap and an arm connected to the leg, the arm of each retainer flap including an opening therein;

the outer bottom panel flap including a locking tab located so as to be associated with a retainer flap in a carrier formed from the blank, each locking tab having a projection extending outwardly from an end edge;

the projection of each locking tab being located so as to extend through the opening in the arm of an associated retainer flap in a carrier formed from the blank, and the end edge of each locking tab being located so as to contact the arm of an associated retainer flap in such a carrier; and means on the locking tabs and the retainer flaps for preventing withdrawal of the locking tabs from engagement with the retainer flaps in a carrier formed from the blank.

13. A wrap-around article carrier blank as defined in claim 12, wherein the opening in the arm of each retainer flap is a slit.

14. A wrap-around article carrier blank as defined in claim 12, wherein the means for preventing withdrawal of the locking tabs comprises a shoulder on each tab and an opening in the leg of each retainer flap, the shoulder and opening being located so as to be aligned in a carrier formed from the blank.

15. A wrap-around article carrier blank as defined in claim 14, wherein the means for preventing withdrawal of the locking tabs further comprises a second shoulder on each tab and a slit in the first bottom panel flap, the second shoulder and the slit in the first bottom panel flap being located so as to be aligned in a carrier formed from the blank.

16. A wrap-around article carrier blank as defined in claim 12, wherein the arm of each retainer flap is connected to the leg of the retainer flap by a fold line.

17. A wrap-around article carrier blank as defined in claim 12, wherein each retainer flap includes article retainer tabs connected on opposite sides thereof along fold lines.

18. A wrap-around article carrier blank as defined in claim 12, wherein the locking tabs are secondary locking tabs, the second bottom panel flap containing at least one primary locking tab and the first bottom panel flap containing at least one primary locking opening.

19. A wrap-around article carrier blank as defined in claim 12, wherein the leg of each article retainer flap is hinged to the first bottom panel flap along a fold line which is substantially parallel to the adjacent end edge of the first bottom panel flap.

20. A wrap-around article carrier blank as defined in claim 12, including coextensive slits in each side panel and each connected bottom panel flap, two of the coextensive slits being located so as to be positioned at opposite ends of a carrier formed from the blank and a pair of coextensive slits being located so as to lie between the end slits, fold lines extending from the ends of the end slits to the end edges of the side panels and the bottom panel flaps, fold lines connecting the ends of the pairs of coextensive slits and intermediate fold lines extending between and substantially parallel to the fold lines extending from the ends of the slits, the portions of the side panels and bottom panel flaps bounded by the slits and associated fold lines forming stepped article dividers in a carrier formed from the blank.

* * * * *